United States Patent [19]

Joó et al.

[11] Patent Number: 4,617,053

[45] Date of Patent: Oct. 14, 1986

[54] METAL REINFORCED POROUS REFRACTORY HARD METAL BODIES

[75] Inventors: Louis A. Joó, Johnson City; Kenneth W. Tucker, Elizabethton; Jay R. Shaner, Johnson City, all of Tenn.

[73] Assignee: Great Lakes Carbon Corporation, Briarcliff Manor, N.Y.

[21] Appl. No.: 778,456

[22] Filed: Sep. 20, 1985

[51] Int. Cl.[4] ..... C22C 29/14

[52] U.S. Cl. ..... 75/244; 148/127; 419/2; 419/12; 419/27; 419/39; 419/57; 419/60; 420/492

[58] Field of Search ..... 419/2, 12, 17, 18, 60, 419/27, 39, 57; 420/492; 148/127; 75/244

[56] References Cited

U.S. PATENT DOCUMENTS

| | | | |
|---|---|---|---|
| 1,548,975 | 8/1925 | Bleecker | 117/47 |
| 2,915,442 | 12/1959 | Lewis | 204/67 |
| 2,934,460 | 4/1960 | Ramadanoff | 117/228 |
| 2,950,979 | 8/1960 | Zosel | 106/56 |
| 2,974,040 | 3/1961 | Fisher et al. | 419/12 |
| 3,294,572 | 12/1966 | Piccione | 117/47 |
| 3,348,943 | 10/1967 | Pollock | 419/12 |
| 3,396,054 | 8/1968 | Gremion | 117/227 |
| 3,400,061 | 9/1968 | Lewis | 204/67 |
| 3,514,559 | 5/1970 | Ranhein | 419/12 |
| 3,549,408 | 12/1970 | Bonne et al. | 117/47 |
| 3,656,989 | 4/1972 | Layland | 117/16 |
| 3,850,668 | 11/1974 | Heffer | 117/47 |
| 4,327,156 | 4/1982 | Dillon et al. | 419/12 |
| 4,376,029 | 3/1983 | Joó et al. | 204/294 |
| 4,377,463 | 3/1983 | Joó et al. | 204/294 |
| 4,439,382 | 3/1984 | Joó et al. | 204/294 |
| 4,465,581 | 8/1984 | Juel et al. | 204/290 R |

FOREIGN PATENT DOCUMENTS

| | | |
|---|---|---|
| 669472 | of 1963 | Canada . |
| 1085086 | of 1960 | Fed. Rep. of Germany . |
| 1905802.7 | of 1970 | Fed. Rep. of Germany . |
| 7008329 | of 1967 | Japan . |
| 5001479 | of 1970 | Japan . |
| 8009254 | of 1973 | Japan . |
| 49-00038 | of 1974 | Japan . |
| 50-04478 | of 1975 | Japan . |
| 4131591 | of 1978 | Japan . |
| 958376 | of 1964 | United Kingdom . |
| 1234634 | of 1971 | United Kingdom . |
| 1244078 | of 1971 | United Kingdom . |
| 1363943 | of 1974 | United Kingdom . |

OTHER PUBLICATIONS

Schwarzkopl & Kieffler Refractory Hard Metals, MacMillan & Co., New York, 1953.

*Primary Examiner*—Stephen J. Lechert, Jr.
*Attorney, Agent, or Firm*—Adrian J. Good

[57] ABSTRACT

A refractory hard metal-metal composite is formed by impregnating a porous refractory hard metal article with molten metal.

2 Claims, No Drawings

METAL REINFORCED POROUS REFRACTORY HARD METAL BODIES

BACKGROUND OF THE INVENTION

The field of refractory hard metals (RHM) has had many advances during the past few years. The RHM's have many properties in common with both ceramics and metals and are consequently of great interest in areas where the properties of hard materials with the temperature resistance and rigidity associated with ceramics, combined with some metal-associated properties such as electrical conductivity, are particularly desired.

The RHM's have other properties which have limited their usage up to the present time. They are usually brittle, have little resistance to thermal shock, and are quite expensive to produce and fabricate into useful articles.

RHM articles have been produced by a number of processes including hot pressing of the granular or powdered materials, chemical vapor deposition, and in situ reduction of metals by carbon or other reducing agents. Hot pressing is the most commonly used process for production of shapes. A die and cavity mold set is filled with powder, heated to about 300°-800° C. and placed under pressure of about $2\times10^8$ Pa, then removed from the mold and heated at about 1500°-2000° C. or higher, or sintered in the mold.

Hot pressing has the limitations of applicability to simple shapes only, erosion of the mold, and slow production. The pieces produced by hot pressing are subject to a high percentage of breakage in handling, making this process expensive in terms of yield of useful products.

The RHM's of most interest include the carbides, borides, and nitrides of the metals of IVA, IVB, VB, and VIB of the periodic table, particularly Ti, V, Si and W.

Past developments in the art include U.S. Pat. No. 4,465,581, Juel et al, disclosing a $TiB_2$-C composite; U.S. Pat. No. 4,439,382, Joó et al, disclosing $TiB_2$ articles produced by an in situ reaction; U.S. Pat. No. 4,377,463, Joó et al, disclosing inert gas processing of $TiB_2$ articles; U.S. Pat. No. 4,376,029 Joó et al, disclosing $TiB_2$-graphite composites, all commonly assigned. Schwarzkopf and Kieffer, Refractory Hard Metals, MacMillan & Co., New York, 1953, disclose much of the technology involved in RHM's. U.S. Pat. No. 3,400,061, Lewis, discloses a RHM Hall cell cathode. U.S. Pat. No. 2,915,442, Lewis, discloses a RHM Hall cell cathode consisting of the borides, carbides and nitrides of Ti, Zr, V, Ta, Nb and Hf.

Impregnation of porous articles with metals is known in the art as disclosed in Japanese Application J78009254 by Toyota disclosing impregnation of $Si_3N_4$, $Al_2O_3$ or C by molten Ag or Al. U.S. Pat. No. 1,548,975 discloses graphite impregnated with Pb, U.S. Pat. No. 2,934,460 discloses C impregnated with Ag, U.S. Pat. No. 2,950,979 discloses C impregnated with Ag or Cu, as does U.S. Pat. No. 3,294,572, U.S. Pat. No. 3,396,054 and U.S. Pat. No. 3,549,408. U.S. Pat. No. 3,656,989 discloses impregnation of C by Mg, Na and K. U.S. Pat. No. 3,850,668 discloses impregnation of C by Ru. Canadian 669,472 discloses impregnation of C by Ti, Zr, Hf, V, Nb, Ta, Cr, Mo, W, Mn and alloys with Ni, Fe, Co and Cu. W. Germany 1,085,086 discloses impregnation of C by Be. Japan J77008329 discloses impregnation of C by Cd. Japan J54131-591 discloses impregnation of C by pitch, Pb, Sn, Al, Cu or resins. U. Kingdom 1,234,634 discloses C impregnated with Al, Sn, Pb, Zn, Sb and Sb-Sn alloys, U. Kingdom 1,244,078 discloses graphite impregnated with a Bi-Ni alloy. U. Kingdom 1,363,943 discloses C impregnated with a series of alloys of Al, Cu, Mg, Mn, Si, Sn, Zn, Be, P, Ni, Cd, Sb and Ag.

There are many other well-known uses of RHM's, e.g. the use of carbides in cutting tools for metalworking and oil well drilling tools. In particular there has been interest in uses for ordnance and armament, both of which depend heavily on their hardness, with the limitations inherent in the brittle nature associated with ceramics.

OBJECTS OF THE INVENTION

It is the principal object of this invention to produce a material of such hardness and sufficient toughness as to be useful in applications for which such physical properties are demanded. The most immediate application is an armor for combat vehicles such as tanks. Other uses include electrodes for molten electrolyte cells valve components in coal liquifaction plants, and structural composites.

SUMMARY OF THE INVENTION

The invention includes a novel process and materials made by the process, which are RHM-metal composites such as $TiB_2$-Cu, $TiB_2$-Fe, $TiB_2$-Al etc., in which the RHM e.g. $TiB_2$, $ZrB_2$ is continuously bonded in a porous structure with approximately 50–80% of the theoretical density, that is, having about 20–50% pore volume and the metal is impregnated into the RHM to fill the porosity. The resulting materials have high melting temperatures, strength, corrosion resistance, and thermal and mechanical shock resistance. They are useful in a great variety of applications including electrodes for molten electrolyte systems such as Hall cells, valves and other components of internal combustion, jet and rocket engines, armament and armor for combat vehicles, and crushing, grinding and drilling equipment.

DETAILED DESCRIPTION OF THE INVENTION

A porous RHM phase is produced by any of a variety of methods, in particular those in the commonly assigned patents cited earlier. The preferred method is the production of a RHM item by simply pouring a powder into a graphite mold and sintering in an inert atmosphere, all steps without the use of applied pressure, producing a porous RHM article.

The furnace temperature cycle and atmosphere must be carefully controlled in this process, as disclosed in Ser. No. 547,483 filed Nov. 1, 1983, which is incorporated herein by reference. A preferred temperature is at least 2000° C. for $TiB_2$ and argon is a preferred atmosphere.

The temperature will vary depending on the specific RHM-metal combination being processed. The preferred temperature range for $TiB_2$-based composites is about 1700°-2300° C.

The preform as produced is impregnated by placing it in an autoclave, reducing the pressure, and impregnating with the molten metal, then gradually cooling.

The resulting articles have improved mechanical and thermal shock resistance properties as compared to dense ceramic and RHM bodies. Their costs of production are lower than for pure RHM bodies since less of the expensive RHM is used and hot pressing is unnecessary. They may be joined to metals to brazing, welding and other well-known techniques, which are much easier and simpler methods than have been previously available for RHM's.

Table 1 shows some typical examples of metals used and properties obtained. A. D. is apparent density, MOE is modulus of elasticity, MOR is modulus of rupture, and CTE is coefficient of thermal expansion over the range of 0°-50° C. The improvements over the properties shown here by the use of our invention are shown in the following tables.

Table 2 shows a set of samples of carbon or graphite reinforced $TiB_2$ according to the invention with the first column giving data on a pure $TiB_2$ sample as a standard. HTT is final or peak heat treatment temperature. E. R. is electrical resistivity and this measurement is used for comparative purposes only. Tables 2 and 3 include specimens made from $TiB_2$ powder supplied by two sources identified as A & B. Samples 24 and 2465 were impregnated with coal tar pitch by the usual method of producing a vacuum and impregnating under pressure with pitch followed by heat treatment to form composites of $TiB_2$ and semi-graphitic carbon.

Table 3 is a set of specimens impregnated with various metals compared with the published data for Ceralloy 225, a $TiB_2$ material supplied by Ceradyne. The materials made with aluminum and cast iron are the preferred materials for this group, displaying very high hardness and toughness. The specimen made by impregnation with cast iron was too hard to saw with the diamond saw available at this laboratory, consequently accurate physical data have not yet been obtained.

Although the examples given above are limited to $TiB_2$ impregnated with metals and alloys, the technique should be useful with other RHM's and most metals, forming an extremely wide variety of materials with many different physical, chemical, and electrical properties useful for a multitude of applications.

TABLE 1

| | Summary of Metals* | | | |
|---|---|---|---|---|
| Material | Grey Cast Iron | Wrought Aluminum 1060 | Electrolyte Tough Pitch Copper C11000 | Bronze C22000 |
| AD | 6.95–7.35 | 2.71 | 8.89 | 8.80 |
| Tensile Strength psi × $10^3$ | 22–62.5 | 8–16 | 32–66 | 37–90 |
| Tensile MOE psi × $10^6$ | 9.6–23.5 | 10 | 17–19 | 17 |
| CTE × $10^7$ | 130 | 193 | 170 | 184 |

*Ref: Metals Handbook

TABLE 2

| | $TiB_2$-CARBON COMPOSITES | | |
|---|---|---|---|
| Sample | 2413-25C | 24-2 | 2465-8-3 |
| $TiB_2$[3] | A | A | B |
| 2nd Phase | — | Carbon | Carbon |
| Final HTT° C. | 2100 | 2300 | 2300 |
| Final AD | 2.69 | 3.12 | 3.39 |
| MOR psi × $10^3$ | 4.55 | 6.45 | 11.77 |
| MOE[1] psi × $10^6$ | 10.1 | 20.0 | 30.8 |
| ER ohm-in × $10^{-5}$ | 1.97 | 1.46 | 1.50 |
| CTE × $10^{-7}$ (0–50° C.) | 47.8 | 48.7 | — |
| Vol. % | | | |
| $TiB_2$ | 59.8 | 63.6 | 70.3 |
| 2nd Phase | 0 | 10.1 | 10.1 |
| Pore Vol. | 40.2 | 26.3 | 19.6 |
| MOR[2]/MOE | 2.05 | 2.08 | 4.50 |

[1]MOE not corrected for Poisson's ratio.
[2]Average of three plates.
[3]Supplier identification.

TABLE 3

| | $TiB_2$-METAL COMPOSITES | | | | |
|---|---|---|---|---|---|
| Sample | 2350-40D-1 | 23-40D-2 | 2413-27B | 2413-27C[2] | Ceralloy 225[3] |
| $TiB_2$ | A | A | A | A | |
| 2nd Phase | Copper | Aluminum | Cast Iron | Bronze | — |
| Final HTT° C. | 2100 | 2100 | 2100 | 2100 | — |
| Final AD | 4.66 | 3.68 | 5.42 | 3.65 | 4.45 |
| MOR psi × $10^3$ | 6.97 | 55.69 | N/A[1] | N/A[1] | 35–50 |
| MOE[6] psi × $10^6$ | 17.7 | 30.3 | " | " | 60–65 |
| ER ohm-in × $10^{-5}$ | 0.53 | 0.27 | " | " | 1.3–1.7 |
| CTE × $10^{-7}$ (0–50° C.) | 84.7 | 110.7 | " | " | 84[4] |
| Vol. % | | | | | |
| $TiB_2$ | 56.5 | 56.8 | 57.9 | 59.0 | 98.8 |
| 2nd Phase | 22.9 | 38.7 | 39.1 | 11.2 | 0 |
| Pore Vol. | 20.6 | 4.5 | 3.0 | 29.8 | 1.2 |
| MOR[2]/MOE | 6.31 | 102.36 | | | 28.9[5] |

[1]Not available
[2]Broke during processing to cool down after impregnation
[3]Ceradyne literature, pure $TiB_2$
[4]RT to 1000° C., all others 0 to 50° C.
[5]Calculated
[6]MOE not corrected for Poisson's ratio

We claim:

1. A refractory hard metal-metal article wherein the refractory hard metal is $TiB_2$ in which the $TiB_2$ is a porous solid with a continuous phase impregnated with a metal selected from the group consisting of iron, copper, aluminum and bronze.

2. A refractory hard metal-metal composite produced by the process of filling a graphite mold with refractory hard metal by gravity only and sintering the refractory hard metal in the mold without applied pressure in an inert atmosphere to a temperature of at least 2000° C. in argon, cooling the molded article, placing the solid refractory hard metal article in a chamber and impregnating said article with a molten metal, to form an article having a continuous phase of refractory hard metal impregnated with a metal, wherein the refractory hard metal is $TiB_2$ and the metal is selected from the group consisting of iron, aluminum, copper and bronze.

* * * * *